US011100763B2

(12) United States Patent
Jenkins et al.

(10) Patent No.: US 11,100,763 B2
(45) Date of Patent: Aug. 24, 2021

(54) LEAD THROUGH INDICATOR CIRCUIT CARD ASSEMBLY

(71) Applicant: Diebold Self-Service Systems, division of Diebold, Incorporated, North Canton, OH (US)

(72) Inventors: Randall W. Jenkins, Orrville, OH (US); Songtao Ma, Wadsworth, OH (US); Rani Solic, North Canton, OH (US)

(73) Assignee: Diebold Self-Service Systems, North Canton, OH (US)

( * ) Notice: Subject to any disclaimer, the term of this patent is extended or adjusted under 35 U.S.C. 154(b) by 497 days.

(21) Appl. No.: 15/518,440

(22) PCT Filed: Oct. 13, 2015

(86) PCT No.: PCT/US2015/055306
§ 371 (c)(1),
(2) Date: Apr. 11, 2017

(87) PCT Pub. No.: WO2016/061088
PCT Pub. Date: Apr. 21, 2016

(65) Prior Publication Data

US 2017/0309134 A1 Oct. 26, 2017

Related U.S. Application Data

(60) Provisional application No. 62/063,178, filed on Oct. 13, 2014.

(51) Int. Cl.
*G07F 19/00* (2006.01)
*H05B 45/24* (2020.01)
(Continued)

(52) U.S. Cl.
CPC ..... *G07F 19/205* (2013.01); *G07F 19/201* (2013.01); *G09G 3/34* (2013.01);
(Continued)

(58) Field of Classification Search
CPC ..... G07F 19/205; G07F 19/20
See application file for complete search history.

(56) References Cited

U.S. PATENT DOCUMENTS 6,318,536 B1 * 11/2001 Korman ..... G06Q 20/18 194/217
2004/0212142 A1 * 10/2004 Graef ..... B65H 3/5284 271/121

(Continued)

FOREIGN PATENT DOCUMENTS

CN 1989530 A * 6/2007
WO 2010140107 A2 12/2010

OTHER PUBLICATIONS canbuskits.com, What is a CAN Bus? Mar. 7, 2010, pp. 1-5 (Year: 2010).*

(Continued)

*Primary Examiner* — Hani M Kazimi
*Assistant Examiner* — Adam Hilmantel
(74) *Attorney, Agent, or Firm* — Black, McCuskey, Souers & Arbaugh LPA

(57) ABSTRACT

In an example embodiment, there is disclosed herein an apparatus with a transceiver coupled with a bus; and a plurality of interfaces coupled with a plurality of lighting devices, and lead through indicator (LTI) logic coupled with the transceiver and the plurality of interfaces. The LTI logic is operable to receive a signal via the bus with data for operating a selected one of the plurality of lighting devices. The LTI logic determines an interface and a channel for the selected one of the plurality of lighting devices. The LTI (Continued)

logic send a signal to the selected one of the plurality of lighting devices on the connector and channel corresponding to the selected one of the plurality of lighting devices to operate the selected lighting device in accordance with the data for operating the selected one of the plurality of lighting devices.

16 Claims, 5 Drawing Sheets

(51) Int. Cl.
*H05B 47/10* (2020.01)
*G09G 3/34* (2006.01)
*H05B 47/165* (2020.01)

(52) U.S. Cl.
CPC ..... *H05B 45/24* (2020.01); *H05B 47/10* (2020.01); *H05B 47/165* (2020.01)

(56) References Cited

U.S. PATENT DOCUMENTS

2007/0139316 A1 6/2007 Hyatt
2012/0131680 A1* 5/2012 Baba ..... G06Q 20/3552 726/26
2013/0027925 A1* 1/2013 Mayer ..... G09G 3/3413 362/230
2015/0013574 A1* 1/2015 Park ..... G07F 19/201 109/23

OTHER PUBLICATIONS

International Preliminary Report on Patentability and Written Opinion of the International Searching Authority filed in the corresponding PCT application; 12 pages.
International Search Report filed in the corresponding PCT application; 6 pages.

* cited by examiner

LEAD THROUGH INDICATOR CIRCUIT CARD ASSEMBLY

CROSS REFERENCE TO RELATED APPLICATIONS

This application claims priority under 35 U.S.C. § 371 to PCT Patent Application No. PCT/US2015/055306 filed Oct. 13, 2015 that claims the benefit under 35 § 119(e) of U.S. Patent Application No. 62/063,178 filed on Oct. 13, 2014, the contents of both applications are hereby incorporated by reference herein.

TECHNICAL FIELD

The present disclosure relates generally to a circuit card assembly (CCA) that provides signals to a plurality of lighting devices that can be employed by an automated banking machine.

BACKGROUND

Automated banking machines may include a card reader that operates to read data from a bearer record such as a user card. Automated banking machines may operate to cause the data read from the card to be compared with other computer stored data related to the bearer or their financial accounts. The machine operates in response to the comparison determining that the bearer record corresponds to an authorized user, to carry out at least one transaction which may be operative to transfer value to or from at least one account. A record of the transaction is often printed through operation of the automated banking machine and provided to the user. Automated banking machines may be used to carry out transactions such as dispensing cash, the making of deposits, the transfer of funds between accounts and account balance inquiries. The types of banking transactions that may be carried out are determined by the capabilities of the particular banking machine and system, as well as the programming of the institution operating the machine.

Other types of automated banking machines may be operated by merchants to carry out commercial transactions. These transactions may include, for example, the acceptance of deposit bags, the receipt of checks or other financial instruments, the dispensing of rolled coin, or other transactions required by merchants. Still other types of automated banking machines may be used by service providers in a transaction environment such as at a bank to carry out financial transactions. Such transactions may include for example, the counting and storage of currency notes or other financial instrument sheets, and other types of transactions. For purposes of this disclosure an automated banking machine, automated transaction machine or an automated teller machine (ATM) shall be deemed to include any machine that may be used to automatically carry out transactions involving transfers of value.

BRIEF DESCRIPTION OF THE DRAWINGS

The accompanying drawings incorporated herein and forming a part of the specification illustrate the example embodiments.

OVERVIEW OF EXAMPLE EMBODIMENTS

Figure 1:
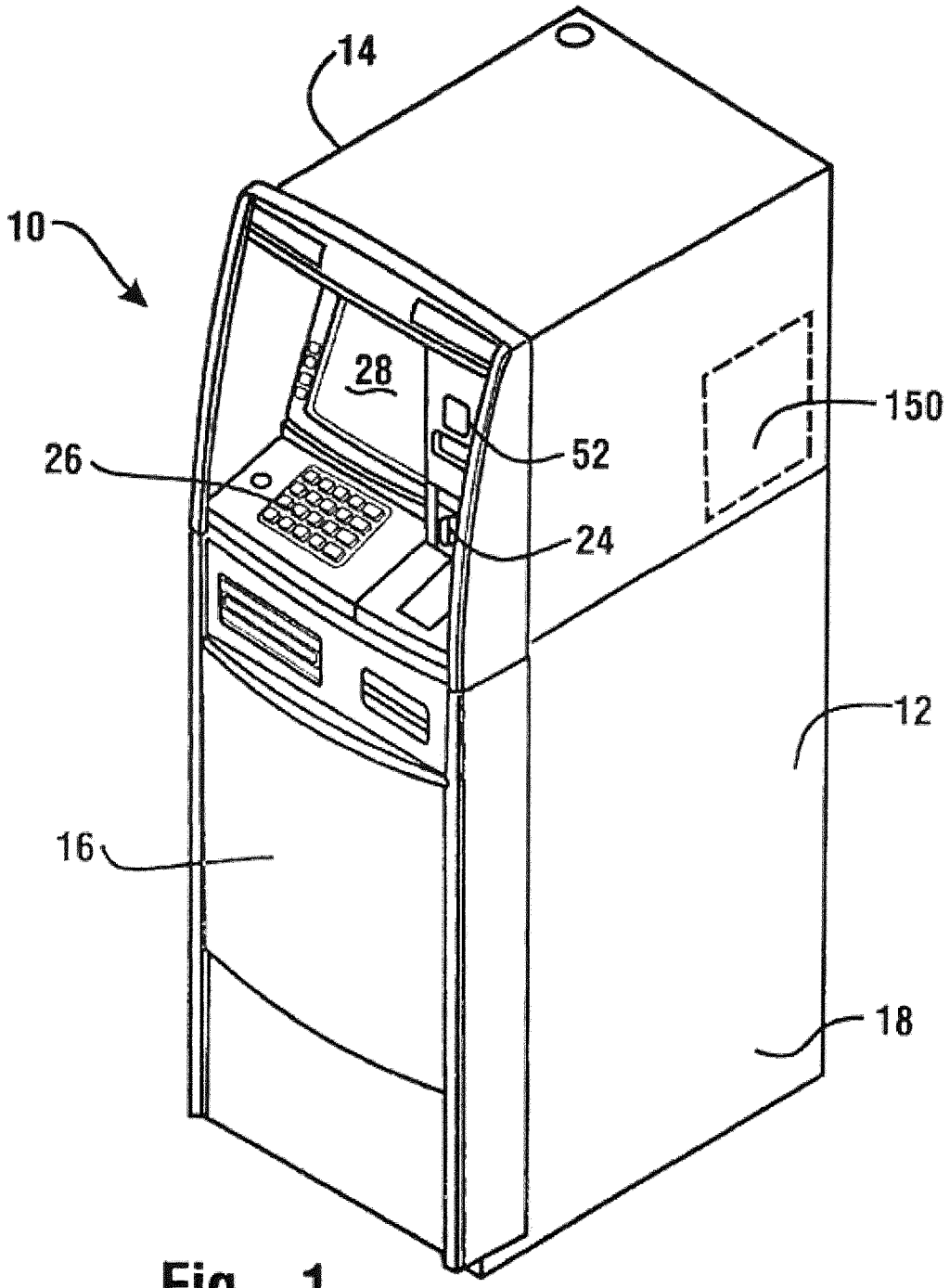
FIG. 1 illustrates an example of an automated banking machine upon which an example embodiment can be implemented.

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein an apparatus comprising a transceiver coupled with a bus, a plurality of interfaces coupled with a plurality of lighting devices, and lead through indicator logic coupled with the transceiver and the plurality of interfaces. The lead indicator logic is operable to receive a signal via the bus with data for operating a selected one of the plurality of lighting devices. The lead through indicator logic is operable to determine an interface corresponding to a connector and a channel for the selected one of the plurality of lighting devices. The lead through indicator logic is operable to send a signal to the selected one of the plurality of lighting devices on the connector and channel corresponding to the selected one of the plurality of lighting devices for operating the selected one of the plurality of lighting devices in accordance with the data for operating the selected one of the plurality of lighting devices. Other embodiments are directed to a method or computer readable medium for implementing the functionality of the lead indicator logic.

In accordance with an example embodiment, there is disclosed herein an apparatus comprising one of a group consisting of a card reader and a cardless card reader, an encrypting personal identification number (PIN) pad (EPP), a receipt printer, a cash dispenser, and a controller coupled with the one of the group consisting of a card reader and a cardless card reader, the encrypting PIN pad, the receipt printer, and the cash dispenser. The apparatus further comprises a lead through indicator operable to selectively control light devices associated with the one of the group consisting of a card reader and a cardless card reader, light devices associated with the encrypting PIN pad, lights associated with the receipt printer, and light devices associated with the cash dispenser, and a hub that is coupled with the controller via a first bus and coupled with the lead through indicator via a second bus, the hub is operative to convert signals received from the controller on the first bus to signals compatible with the second bus and forward the signals onto the second bus to the lead through indicator. The hub is operable to receive signals from the controller via the hub on the second bus that include commands to operate a selected one of the light devices associated with the one of the group consisting of the card reader and the cardless card reader, the encrypting PIN pad, the receipt printer, and the cash dispenser. The lead through indicator is operable to determine an interface corresponding to a connector and a channel for the selected one of the plurality of lighting devices. The lead through indicator logic is operable to send a signal to the selected one of the plurality of lighting devices on the connector and channel corresponding to the selected one of the plurality of lighting devices for operating the selected one of the plurality of lighting devices in accordance with the commands.

DESCRIPTION OF EXAMPLE EMBODIMENTS

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

FIG. 1 illustrates an example of an automated banking machine 10 upon which an example embodiment can be implemented. In an example embodiment, the automated banking machine 10 operates to cause financial transfers using information read from data bearing records such as user cards. Those skilled in the art should readily appreciate that the illustrated example (an automated teller machine or "ATM") was selected merely for ease of illustration and that the example embodiments described herein are not limited to any particular type of automated banking machine. The example automated banking machine 10 includes a housing 12. In the illustrated embodiment, the housing 12 includes an upper housing area 14 and a lower housing area 16. The lower housing area 16 includes a secure chest portion 18. Access to an interior area of the chest portion 18 is controlled by a chest door 20 (see FIG. 2), which when unlocked allows access to the interior area 22 of the chest area. In an example embodiment, access to the upper housing area 14 may be made through an appropriate opening in the housing 12. The opening to the interior area of the upper housing portion 14 may also be controlled by a movable door 150 that may be in a front, rear or side of the upper housing area 14. In other embodiments, the housing may include several openings to the interior area. In an exemplary embodiment, the chest door 20 may be situated at the front of the housing, for so called "front-load" ATMs or at the rear of the housing for "rear-load" ATMs. Examples of ATM housing structures are shown in U.S. Pat. Nos. 7,156,296; 7,156,297; 7,165,767; and 7,004,384, the disclosures of which are hereby incorporated herein by reference.

In an example embodiment, the ATM 10 includes a number of transaction function devices. These transaction function devices include, but are not limited to, a card reader 24 and a keypad 26. The card reader 24 and the keypad 26 serve as input devices through which users can input instructions and information. It should be understood that as referred to herein the keypad may include function keys or touch screen areas which may be used in embodiments to input data into the machine. ATM 10 further includes a visual display 28 generally operative as an output device to provide information to users of the machine. The information provided may include information concerning cash dispensing transactions. The card reader 24 is used to read data from user cards that can be used to identify customer financial accounts to the machine. In some embodiments the card reader may be a magnetic stripe type reader. In other embodiments the card reader may be a smart card reader, or a contactless reader such as a radio frequency identification (RFID) reader or near-field communication (NFC) reader. Particular embodiments may include camera 52.

Figure 2:
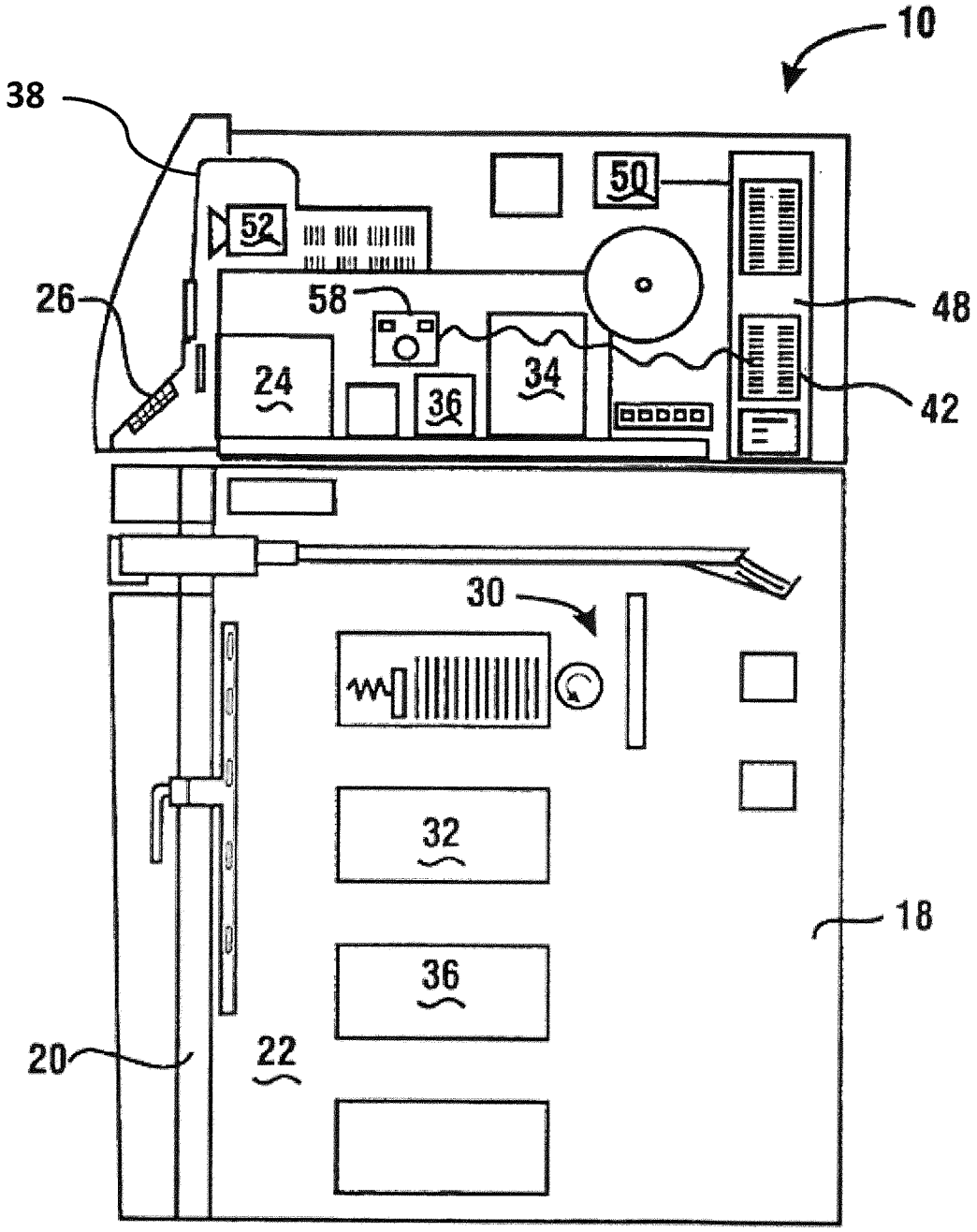
FIG. 2 is a side view of the automated banking machine illustrated in FIG. 1.

FIG. 2 shows a schematic view of an example hardware configuration of ATM 10. The ATM 10 includes additional transaction function devices. Such transaction function devices may include a document dispensing mechanism, including a dispenser, schematically indicated 30, which operates to cause sheets such as currency bills or other documents of value stored within the machine to be delivered from the machine to a machine user. Such mechanisms are referred to herein as a cash dispenser. Examples of such cash dispensers are shown in U.S. Pat. Nos. 7,121,461; 7,131,576; 7,140,537; 7,140,607; 7,144,006; and 7,000,832 the disclosures of which are incorporated herein by reference.

The exemplary ATM 10 further includes a depository 32. The depository 32 accepts deposits such as cash or other instruments such as checks from customers. It should be understood that in other embodiments other types of depositories which accept various types of items representative of value may be used. Examples of depository devices are shown in U.S. Pat. Nos. 7,156,295; 7,137,551; 7,150,394; and 7,021,529 the disclosures of which are incorporated hereby by reference. Exemplary ATMs may also include a note acceptor of the types described in the incorporated disclosures. An example embodiment may include a printer 34 operative to print customer receipts related to the transaction. Example embodiments may include other transaction function devices, such as a coin dispenser, coin acceptor, currency stacker, ticket accepting devices, stamp accepting devices, card dispensing devices, money order dispensing devices, and other types of devices which are operative to carry out transaction functions. Some of these devices may be located in the upper or lower housing areas, all generally schematically represented as 36. It should be understood that the embodiment shown is merely illustrative and automated banking machines of various embodiments may include a variety of transaction function devices and component combinations.

In an example embodiment, the automated banking machine includes a camera 52. The images captured by the camera 52 may be used, for example, to verify identity and/or provide security for the ATM 10 or users thereof. In an example embodiment, the ATM 10 may further include a data store 50 containing data corresponding to images of unauthorized users of the ATM 10. In an example embodiment, a controller 48 is able to compare data corresponding to the images captured by camera 52 with data in the data store 50 corresponding to unauthorized users. If the data generated by camera(s) 52 corresponds to unauthorized user, the controller 48 is operative to carry out instructions, such as to activate an indicator which indicates the presence of the unauthorized user. The indicator may be an audible alarm, a message to a remote entity, a machine shut-down operation, or any other action able to indicate attempted use of or access to the machine by an unauthorized user. Alternatively, in some embodiments the data store 50 may be located remotely. In other embodiments the data stored in data store 50 may correspond to authorized users. Determining through operation of one or more controllers 48 that image data corresponds to an authorized user may permit such authorized users to carry out certain operations.

In the example embodiment, ATM 10 also includes a movable image capture device 58 such as a camera, in operative connection with interface bus 42. When the ATM 10 is in an operational mode, the movable image capture device 58 may be housed within the upper housing area 14. Alternately, a movable device may be housed within the lower housing area 12. Alternatively, in some embodiments, the movable image capture device 58 may be brought to the ATM 10 by a servicer and operatively connected to at least one controller 48, such as by plugging in a cable connected to a camera to a USB (Universal Serial Bus) port. After a servicer attains access to the interior of the ATM housing, the movable image capture device 58 may be utilized to aid servicing of the ATM 10.

In an example embodiment, the ATM 10 comprises a lead through indicator (LTI) circuit card assembly (CCA), which will be described in more detail herein infra, for operating lights on fascia 38. The lights can be used to lead a consumer through a transaction by directing the customer's attention to particular devices where an activity is being performed (e.g., insert card, retrieve cash, or retrieve receipt.

Those skilled in the art should readily appreciate that the components and layout used in FIGS. 1 and 2 were selected for ease of illustration. Therefore, the example embodiments should not be construed as limited to the illustrated architectures.

In an example embodiment, as will be described in further detail herein infra, the ATM 10 further includes a lead through indicator (LTI) circuit card assembly for controlling indicator lights associated with the transaction function devices of the ATM. In particular embodiments, the LTI CCA is mounted on the fascia 38 and is coupled to the ATM controller via a controller area network bus (CAN bus). This can result in shorter connectors to the indicator lights and reduced wiring costs since the CAN bus uses two wires, where the connectors may have four wires per channel.

Figure 3:
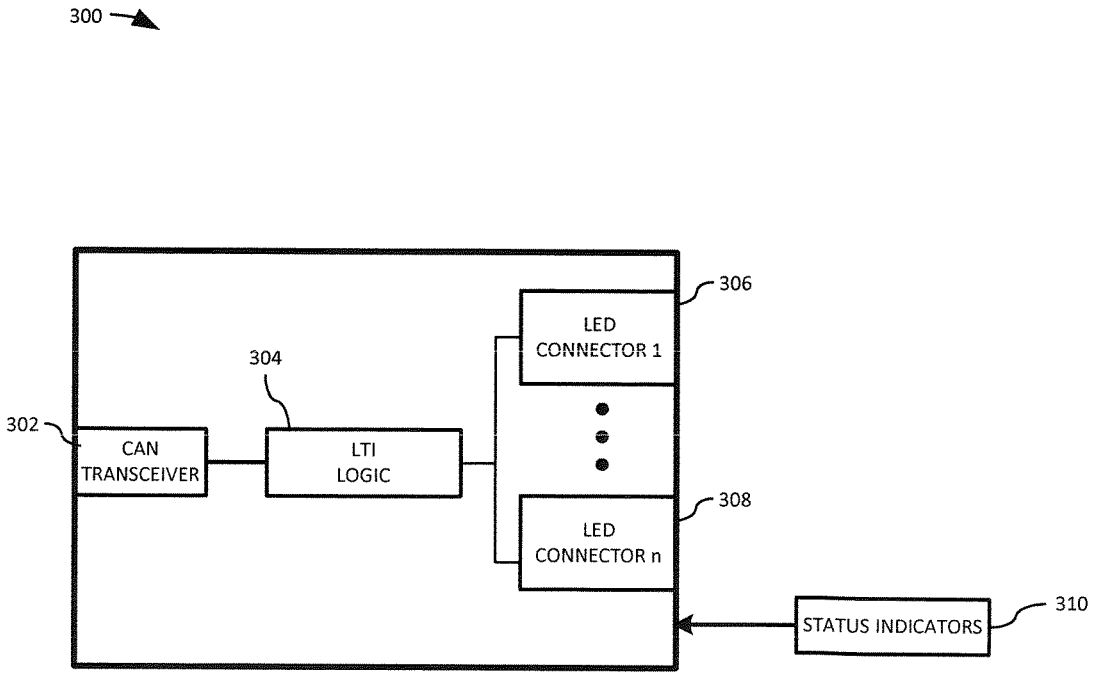
FIG. 3 is a block diagram illustrating an example of a lead through indicator circuit card assembly.

FIG. 3 is a block diagram illustrating an example of a lead through indicator circuit card assembly (LTI CCA) 300. The LTI CCA 300 comprises a CAN bus transceiver 302, LTI logic 304 and a plurality of LED connectors 306, 308. "Logic", as used herein, includes but is not limited to hardware, firmware, software and/or combinations of each to perform a function(s) or an action(s), and/or to cause a function or action from another component. For example, based on a desired application or need, logic may include a software controlled microprocessor, discrete logic such as an application specific integrated circuit (ASIC), a programmable/programmed logic device, memory device containing instructions, or the like, or combinational logic embodied in hardware. Logic may also be fully implemented in software embodied on a tangible, non-transitory computer-readable medium that performs the described functionality when executed by processor. The illustrated example shows n connectors 306, 308. Those skilled in the art should readily appreciate that n can an integer between 2 and any physically realizable number of connectors. The number of connectors illustrated in FIG. 3 was selected merely for ease of illustration and should not be considered limiting in any way.

In an example embodiment, the LTI logic 304 is operable to receive a signal from a CAN bus via CAN transceiver 302. The signal comprises data for operating a selected one of the plurality of lighting devices. The LTI logic 304 is operable to determine a connector (one of connectors 306, 308) and a channel for the selected one of the plurality of lighting devices. The LTI 304 logic is operable to send a signal to the selected one of the plurality of lighting devices on the connector and channel corresponding to the selected one of the plurality of lighting devices for operating the selected one of the plurality of lighting devices in accordance with the data for operating the selected one of the plurality of lighting devices.

In an example embodiment, at least one of the connectors 306, 308 comprises a plurality of channels that correspond to plurality of lighting devices. For example, connector 306 may have two channels corresponding to two lighting devices or three channels corresponding to three lighting devices.

In an example embodiment, the connector may suitably comprise four connectors, one for supply voltage, one for a red color signal, one for a blue color signal, and one of a green color signal.

In an example embodiment, the plurality of lighting devices are light emitting diodes (LEDs). The LEDs may be multicolored LEDs. Thus, the LTI logic 304 may provide the appropriate signals to the appropriate LEDs to achieve a desired color. In particular embodiments, the LTI logic 304 also sends signals to control the blinking frequency (flash rate) and intensity of the LEDs.

In an example embodiment, the LTI logic 304 is operable to receive feedback indicating the status of the LEDs, collectively indicated as 310 in FIG. 3. For example, the status indicators may provide data indicating whether a particular LED has a short or open circuit.

In an example embodiment, the LTI logic 304 is operable to obtain data representative of current being used by a channels in connectors 306, 308. The LTI logic 304 is operable to remove power to a channel responsive to detecting an over current on the channel.

Figure 4:
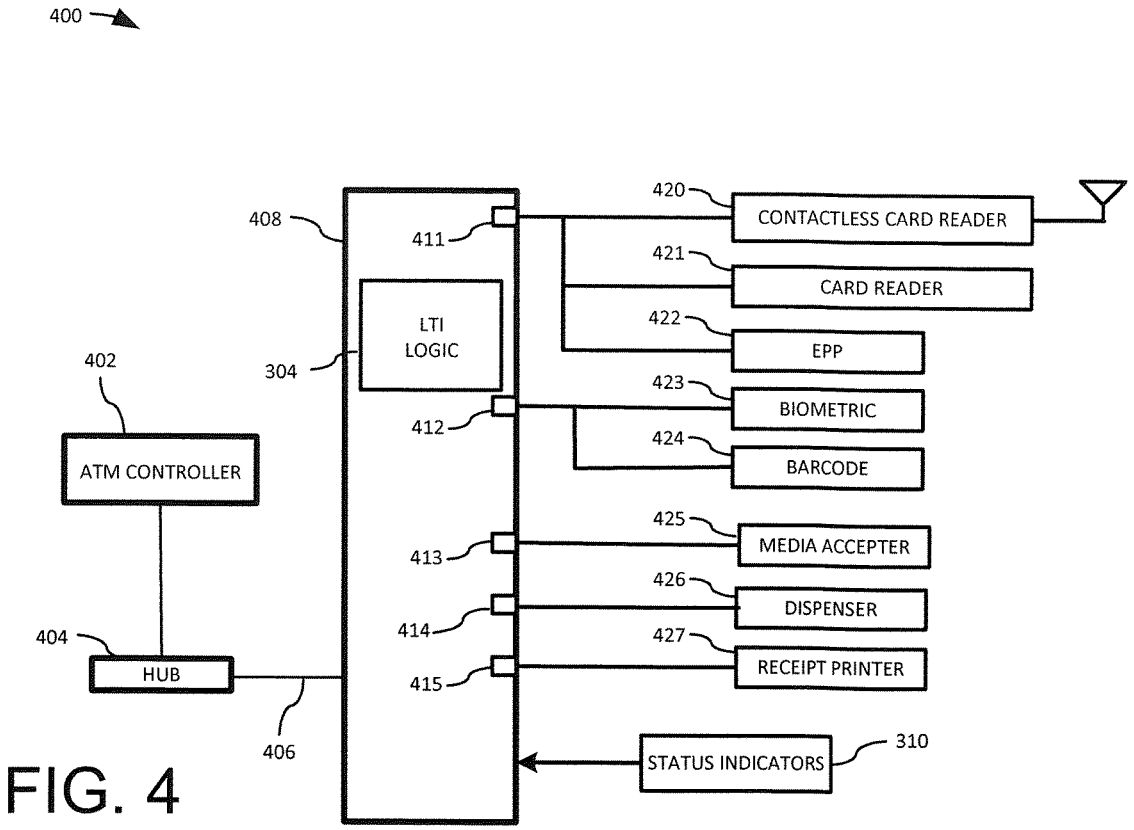
FIG. 4 is a block diagram illustrating an example of an automated banking machine employing a lead through indicator circuit card assembly for operating indicator lights.

FIG. 4 is a block diagram illustrating an example of an automated banking machine (an automated teller machine or "ATM" in this example) 400 with a controller 402 operable to detect an unauthorized device 430 on a CAN bus 406 in the automated banking machine 400. In an example embodiment, the ATM 40 comprises one of a group consisting of a card reader and a cardless card reader, an encrypting personal identification number (PIN) pad (or "EPP"), a receipt printer, and a cash dispenser (not shown, see e.g., FIGS. 1 and 2). The controller 402 is coupled with the one of the group consisting of a card reader and a cardless card reader, the EPP, the receipt printer, the cash dispenser and the hub 404.

In an example embodiment, the ATM controller 402 is operable to communicate with the hub 404 that is coupled via CAN bus 406 to LTI CCA 408. The hub converts commands from the ATM controller 402 for routing onto the CAN bus 406. By locating the LTI CCA 408 on the fascia 38 (FIG. 1) near the location of the lighting devices (e.g., LEDs), this can allow for shorter wiring runs to the to the lighting devices. Another aspect is that only the CAN bus wires (two wires) are provided to the fascia 38 (FIG. 1) for controlling the lighting devices 420, 421, 422, 423, 424, 425, 426, 427. This can simplify the wiring between the fascia 38 (FIG. 1) and the ATM controller 402.

In an example embodiment, LTI logic is 304 is operable to selectively operate light devices 420, 421, 422, 423, 424, 425, 426, 427. In the illustrated example, lighting device 420 is associated with a contactless (e.g., wireless or near field communication "NFC") card reader, lighting device 421 is associated with a card reader (such as a motorized or DIP card reader), lighting device 422 is associated with an encrypting PIN pad (EPP) 422, lighting device 423 is associated with a biometric reading device, lighting device 424 is associated with a barcode reader, lighting device 425 is associated with a media accepter (such as a currency acceptor, check acceptor, or a mixed media accepter "MMA"), lighting device 426 is associated with a cash dispenser 426 and lighting device 427 is associated with a receipt printer. In the illustrated example, lighting devices 420, 421, 422 are coupled with connector 411 on three separate channels. Lighting devices 423 and 424 are coupled to connector 412 on two separate channels. Lighting devices 425, 426, 427 are coupled to connectors 413, 414, 415 respectively which have a single channel. Those skilled in the art should readily appreciate that the example embodiments herein should not be limited to the illustrated lighting devices 420, 421, 422, 423, 424, 425, 426, 427 or connectors 411, 412, 413, 414, 415 as any suitable arrangement of lighting devices or connectors may be employed.

The following are examples of how the lighting devices 420, 421, 422, 423, 424, 425, 426, 427 may be operated. For example, before a customer has begun operating an ATM, LTI logic 304 may operate the lighting devices 420 and 421 to blink green, indicating a consumer may begin operating the ATM by placing a card near (or in) the card reader. If the card could not be read, the appropriate lighting device (e.g., one of lighting devices 420 and 421) may blink red to indicate that the card was not read. If the card is read properly, then lighting device 422 may blink green to indicate that the consumer should enter their PIN. If the consumer is making a deposit, lighting device 423 may blink green when ready to accept the deposit and red if there's a problem with the deposit (for example the check or cash being deposited could not be read properly). If the consumer makes a cash withdrawal, the lighting device 426 associated with the cash dispenser may blink green when the cash is ready for delivery to the consumer. At the conclusion of a transaction, the lighting device 427 may blink green to indicate a receipt is ready (or red if the printer is out of ink or paper).

In an example embodiment, the LTI logic 304 is operable to receive a signal from a CAN bus 406. The signal comprises data for operating a selected one of the plurality of lighting devices. The LTI logic 304 is operable to determine a connector (one of connectors 411, 412, 413, 414, 415) and a channel for the selected one of the plurality of lighting devices. The LTI 304 logic is operable to send a signal to the selected one of the plurality of lighting devices through the connector and channel corresponding to the selected one of the plurality of lighting devices for operating the selected one of the plurality of lighting devices in accordance with the data for operating the selected one of the plurality of lighting devices.

In an example embodiment, connectors 411, 412, 413, 414, 415 may suitably comprise four connectors, one for supply voltage, one for a red color signal, one for a blue color signal, and one of a green color signal. For connectors with multiple channels (e.g. connectors 410, 411) there may be four connectors per channel.

In an example embodiment, the plurality of lighting devices are light emitting diodes (LEDs). The LEDs may be multicolored LEDs. Thus, the LTI logic 304 may provide the appropriate signals to the appropriate LEDs to achieve a desired color. In particular embodiments, the LTI logic 304 also sends signals to control the blinking frequency (flash rate) and intensity of the LEDs.

In an example embodiment, the LTI logic 304 is operable to receive feedback indicating the status of the LEDs, collectively indicated as 310. For example, the status indicators may provide data indicating whether a particular LED has a short or open circuit.

In an example embodiment, the LTI logic 304 is operable to obtain data representative of current being used by a channels in connectors 411, 412, 413, 414, 415. The LTI logic 304 is operable to remove power to a channel responsive to detecting an over current on the channel.

Figure 5:
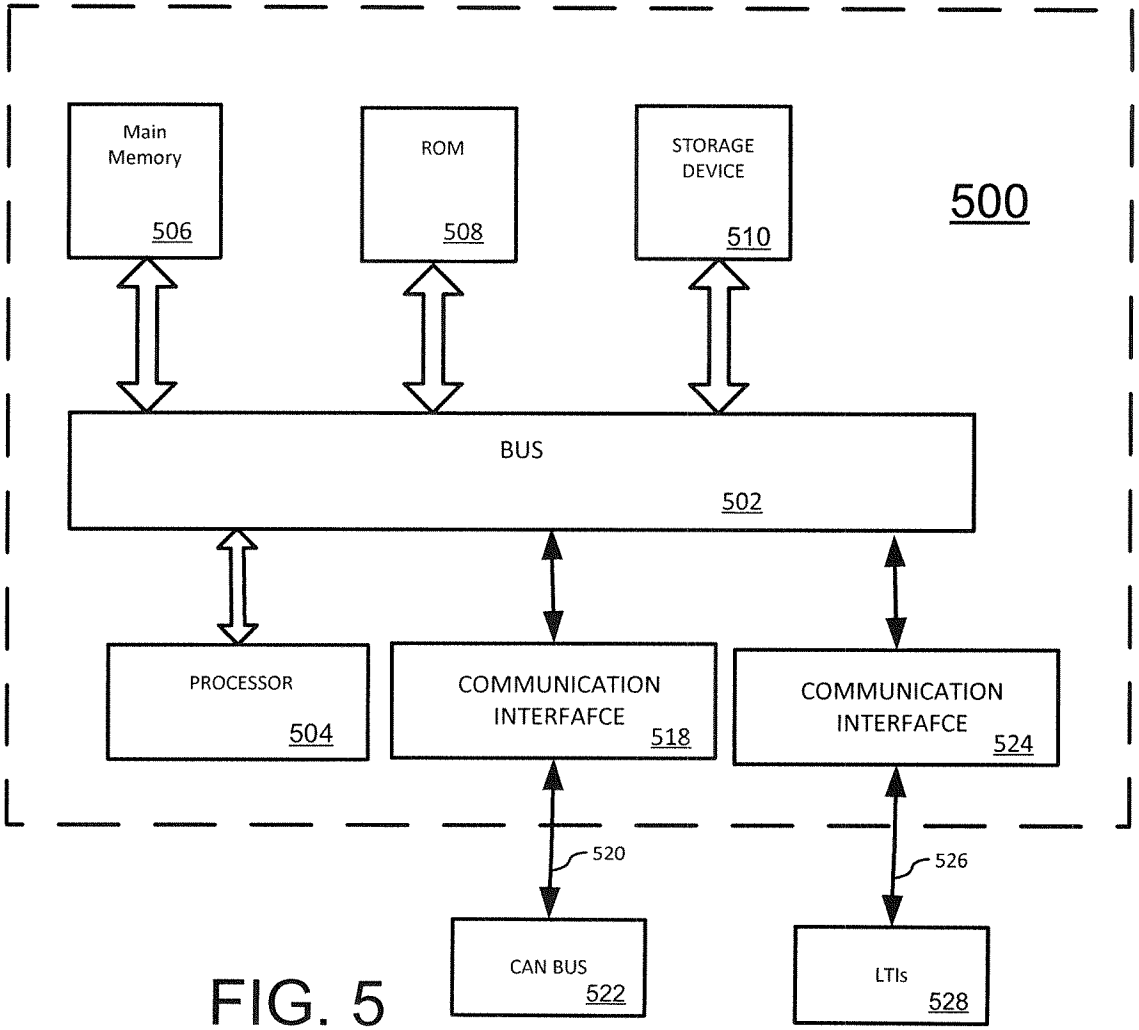
FIG. 5 is a block diagram that illustrates a computer system upon which an example embodiment may be implemented.

FIG. 5 is a block diagram that illustrates a computer system 500 upon which an example embodiment may be implemented. Computer system 500 is suitable for implementing the functionality of LTI logic 304 described in FIGS. 3 and 4.

Computer system 500 includes a bus 502 or other communication mechanism for communicating information and a processor 504 coupled with bus 502 for processing information. Computer system 500 also includes a main memory 506, such as random access memory (RAM) or other dynamic storage device coupled to bus 502 for storing information and instructions to be executed by processor 504. Main memory 506 also may be used for storing a temporary variable or other intermediate information during execution of instructions to be executed by processor 504. Computer system 500 further includes a read only memory (ROM) 508 or other static storage device coupled to bus 502 for storing static information and instructions for processor 504. A storage device 510, such as a magnetic disk or optical disk, is provided and coupled to bus 502 for storing information and instructions.

An aspect of an example embodiment is related to the use of computer system 500 for a power control hub. According to one embodiment, the functionality of the power control hub is provided by computer system 500 in response to processor 504 executing one or more sequences of one or more instructions contained in main memory 506. Such instructions may be read into main memory 506 from another computer-readable medium, such as storage device 510. Execution of the sequence of instructions contained in main memory 506 causes processor 504 to perform the process steps described herein. One or more processors in a multi-processing arrangement may also be employed to execute the sequences of instructions contained in main memory 506. In alternative embodiments, hard-wired circuitry may be used in place of or in combination with software instructions to implement an example embodiment. Thus, embodiments described herein are not limited to any specific combination of hardware circuitry and software.

The term "computer-readable medium" as used herein refers to any medium that participates in providing instructions to processor 504 for execution. Such a medium may take many forms, including but not limited to non-volatile media. Non-volatile media include for example optical or magnetic disks, such as storage device 510. Common forms of computer-readable media include for example floppy disk, a flexible disk, hard disk, magnetic cards, paper tape, any other physical medium with patterns of holes, a RAM, a PROM, an EPROM, a FLASHPROM, CD, DVD or any other memory chip or cartridge, or any other medium from which a computer can read.

Computer system 500 also includes a communication interfaces, or ports, 520, 526 coupled to bus 502. In the illustrated example two ports 520, 526 are illustrated, however, those skilled in the art should readily appreciate that computer system 500 may have as few as one port or any physically realizable number of ports. Communication interfaces 520, 526 are coupled to busses 518, 524 via links 522, 528 respectively. Links 522, 526 may comprise wired, wireless, or any combination of wired and wireless links.

For example, processor 504 may monitor bus 522 via communication interface 518 and obtain data representative of addresses used on the bus. If the processor 504 determines an address on the bus belongs to an authorized device (for example another device is detected using the same address as computer system 500), the processor 504 may take corrective action as described herein. For example, the processor 504 may signal devices on bus 522 to power down or send a signal (such as an alarm signal) on bus 528.

Figure 6:
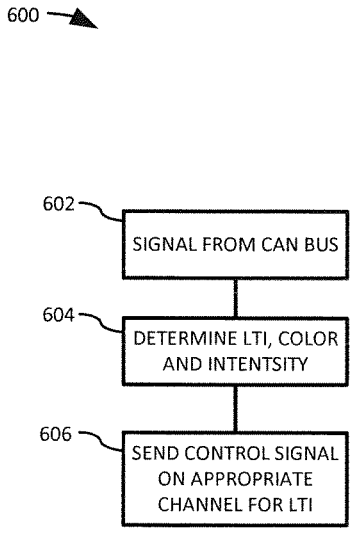
FIG. 6 illustrates an example of a method of operation for a lead through indicator circuit card assembly monitoring a bus for unauthorized devices.

In view of the foregoing structural and functional features described above, a methodology 600 in accordance with an example embodiment will be better appreciated with reference to FIG. 6. While, for purposes of simplicity of explanation, the methodology 600 of FIG. 6 is shown and described as executing serially, it is to be understood and appreciated that the example embodiment is not limited by the illustrated order, as some actions could occur in different orders and/or concurrently with other actions from that shown and described herein. Moreover, not all illustrated features may be required to implement a methodology in accordance with an example embodiment. The methodology 600 described herein is suitably adapted to be implemented in hardware, software, software when executed by a processor (such as processor 504 in computer system 500 in FIG. 5), or a combination thereof. For example, methodology 600 may be implemented by LTI logic 304 described in FIGS. 3 and 4, or computer system 500 described in FIG. 5. FIG. 6 illustrates an example of a methodology for monitoring a bus for unauthorized devices.

At 602, a signal from a hub coupled to an ATM controller (or from the ATM controller) is received requesting an operation for a lead through indicator (LTI). In an example embedment, the signal is received on a CAN bus.

At 604, the lead through indicator is determined. In particular embodiments, the color, intensity, blink rate or any combination thereof may be determined from the signal received from the ATM controller.

At 606, a control signal is sent to the appropriate lead through indicator on a connector and channel that is appropriate for the lead through indicator. The control signal commands the LTI to perform the requested operation.

The actions described in 602, 604, 606 may be repeated as often as desired. For example, these actions may be repeated whenever the ATM controller sends a command to change a lighting parameter for a lead through indicator lighting device.

Described above are example embodiments. It is, of course, not possible to describe every conceivable combination of components or methodologies for purposes of describing the example embodiments, but one of ordinary skill in the art will recognize that many further combinations and permutations of the example embodiments are possible. Accordingly, it is intended to embrace all such alterations, modifications and variations that fall within the spirit and scope of any claims filed in applications claiming priority hereto interpreted in accordance with the breadth to which they are fairly, legally and equitably entitled.

The invention claimed is:

1. An apparatus, comprising:

a lead through indicator circuit card assembly mounted on a fascia of an automated banking machine for operating a plurality of lighting devices on the fascia of the automated banking machine to lead a consumer through a transaction by directing a consumer's attention to particular devices where an activity is being performed, the lead through indicator circuit card assembly further comprises a transceiver; and a plurality of interface-connectors to be coupled with the plurality of lighting devices, and a lead through indicator logic coupled with the transceiver and the plurality of interface-connectors;

a controller that controls the operation of the plurality of lighting devices; and a single connection between the controller and the lead through indicator circuit card assembly;

wherein the controller is configured to select a lighting device from the plurality of lighting devices and an operating parameter for the selected lighting device;

the controller is configured to send a signal to the lead through indicator circuit card assembly via the single connection, the signal comprising data for operating a selected one of the plurality of lighting devices;

the lead through indicator logic is configured to receive the signal from the controller via the transceiver;

the lead through indicator logic is configured to determine an interface-connector from the plurality of interface-connectors and a channel of the determined interface-connector that corresponds to the selected one of the plurality of lighting devices;

the lead through indicator logic is further configured to send an output signal to the selected one of the plurality of lighting devices via the determined interface-connector and the channel of the determined interface-connector corresponding to the selected one of the plurality of lighting devices for operating the selected one of the plurality of lighting devices in accordance with the data included in the received signal for operating the selected one of the plurality of lighting devices; and the sending of the output signal causes the selected one of the plurality of lighting devices to operate in accordance with the data for operating the selected one of the plurality of lighting devices in the signal received from via the transceiver.

2. The apparatus set forth in claim 1, wherein at least one interface-connector of the plurality of interface-connectors comprises at least two channels,wherein each of the at least two channels corresponds to one of the plurality of lighting devices.

3. The apparatus set forth in claim 2, wherein the single connection is a controller area network bus.

4. The apparatus set forth in claim 3, wherein the plurality of lighting devices are light emitting diodes (LEDs).

5. The apparatus set forth in claim 4, wherein the lead through indicator logic is configured to receive a status indication signal indicating an inoperative lighting device of the plurality of lighting devices.

6. The apparatus set forth in claim 5, wherein the status indication signal includes data indicating one of a group consisting of data indicating a short circuit and data indicating an open circuit.

7. The apparatus set forth in claim 4, the lead through indicator logic is to remove power from one of the at least two channels responsive to detecting an over current on the one channel.

8. The apparatus set forth in claim 4, wherein the at least one interface-connector of the plurality of interface-connectors comprises per channel a supply voltage connector, a red signal connector, a blue signal connector, and a green signal connector.

9. The apparatus set forth in claim 8, wherein the output signal to the selected one of the plurality of lighting devices includes data representative of color.

10. The apparatus set forth in claim 9, wherein the output signal to the selected one of the plurality of lighting devices includes data representative of intensity.

11. The apparatus set forth in claim 10, wherein the output signal to the selected one of the plurality of lighting devices includes data representative of blinking frequency.

12. A method, comprising:

operating a controller connected to a lead through indicator circuit card assembly by a single connection to select a lighting device from a plurality of lighting devices mounted on a fascia of an automated banking machine that are coupled with the lead through indicator circuit card assembly, wherein the lead through circuit card assembly is located on the fascia and the controller is not located on the fascia, to select a selected operation for a selected one of the plurality of lighting devices;

sending, by the controller, a signal to the lead through indicator circuit card assembly via the single connection, the signal comprising the selected operation for the selected one of the plurality of lighting devices;

receiving, by the lead through indicator circuit card assembly, from the controller, avia the single connection, the signal with data for operating a selected one of a plurality of lighting devices;

determining an interface-connector and a channel of the interface-connector for the selected one of the plurality of lighting devices; and sending an output signal to the selected one of the plurality of lighting devices on the interface-connector and the channel corresponding to the selected one of the plurality of lighting devices for operating the selected one of the plurality of lighting devices in accordance with the data for operating the selected one of the plurality of lighting devices;

wherein the sending of the output signal causes the selected one of the plurality of lighting devices to operate in accordance with the data for operating the selected one of the plurality of lighting devices in the signal received from via the transceiver.

13. The method set forth in claim 12, wherein the single connection is a controller area network (CAN) bus.

14. The method of claim 12, wherein the output signal to the selected one of the plurality of lighting devices includes data representative of color.

15. The method of claim 12, wherein the output signal to the selected one of the plurality of lighting devices includes data representative of intensity.

16. The method of claim 12, wherein the output signal to the selected one of the plurality of lighting devices includes data representative of blinking frequency.

* * * * *